United States Patent [19]

Schauer

[11] 4,071,441

[45] Jan. 31, 1978

[54] BYPASS SEPARATOR

[75] Inventor: Siegfried Schauer, Kaiserslautern-Hohenecken, Germany

[73] Assignee: Gebr. Pfeiffer AG, Kaiserlougen, Germany

[21] Appl. No.: 636,210

[22] Filed: Nov. 28, 1975

[30] Foreign Application Priority Data

Dec. 3, 1974 Germany ..... 2456970

[51] Int. Cl.[2] ..... B07B 7/083

[52] U.S. Cl. ..... 209/144; 209/138; 209/145

[58] Field of Search ..... 209/138, 139 R, 140, 209/141, 143, 144, 145; 241/79, 79.2, 80, 53, 58

[56] References Cited

U.S. PATENT DOCUMENTS

| | | | |
|---|---|---|---|
| 2,125,207 | 7/1938 | Suggs | 209/139 R |
| 2,381,954 | 8/1945 | Hardinge | 209/144 |
| 2,638,219 | 5/1953 | Gordon et al. | 209/144 |
| 3,398,829 | 8/1968 | Brown | 209/140 X |
| 3,466,853 | 9/1969 | Buick et al. | 209/144 X |

FOREIGN PATENT DOCUMENTS

| | | | |
|---|---|---|---|
| 289,974 | 7/1953 | Switzerland | 209/139 R |

*Primary Examiner*—Frank W. Lutter
*Assistant Examiner*—Ralph J. Hill
*Attorney, Agent, or Firm*—Orville N. Greene; Frank L. Durr

[57] ABSTRACT

A separator for the particles of a particle-air stream is provided which is capable of varying the composition of the particles obtained from the stream by providing typical swirling-air type separators with a by-pass whereby a portion of the original particle-air stream can be passed by the separation zone without being acted on by the swirling air.

6 Claims, 7 Drawing Figures

BYPASS SEPARATOR

This invention relates to a separator such as is installed in an air-stream milling plant for the grinding of solid materials. By changing the spinning of the powder-air currents in the separator, the composition of the final product is controlled.

Usually, the composition of the powder leaving the separator after its granulation, hence its so called grain development or grain size distribution is registered in a grain lattice diagram which is a more or less steep, s-form curve sloped from the lower left to the upper right. A control of the curve development through the change of the spin of the powder-air current in the direction of a change of the fine and/or large components is indeed, as stated above, possible, but is achievable only within narrow limits. The slope of the S-form curve, a criterion for the components of different grain size, can only be influenced slightly.

The invention is based accordingly on the problem of developing such a separator that a greater adjustability of the end product (as measured by the s-curve) is possible, so much so, as a criterion for this influence, to produce a change in the slope of the s-curve.

The invention solves this problem through a separator which is provided with a by-pass in the area of the separation zone. A part of the powder-air current supplied to the separator can be withdrawn from the actual separation over this by-pass and then again supplied upstream of the separation zone to the final material stream.

The separator under consideration here works either with a rotating propeller which serves for producing the whirling of the powder-air stream whereby more or less of a whirl will be produced through a speed change, or with an airstream-flap separator, by which the whirl is controlled through variation of the intake angle of the flappers or guide vanes. Both embodiments can be equipped with a by-pass in accordance with the invention.

Since in principle with such a process as the known separations, the total amount of the powder-air mix fed to the separator undergoes the separation treatment, whereby material components too coarse, the grit, separates and returns to the disintegrator connected in series to the separator or is deposited in a separate apparatus, it is possible, by appropriate arrangement of the by-pass of the separator of the invention to sieze, divert and add to the finished material stream, a part of the return-flowing grit.

The by-pass can be produced in or on the separator by rigid structures. It can also be made to pass through a suitable structure of the inner area of the rotating fan.

It is, for example, possible to build the housing of the separator in the form of a double wall, so that an annular ring will form an annular duct surrounding the separation zone of the whirl produced through the fan wheel. Instead of this annular duct, one or more deviating means can be arranged outside the separator housing whereby the outlet openings for these deviating means may be adjustable in the radial direction.

A further possibility consists in equipping the inner area of the separator vanes with passages through which a part of the powder-air stream can be diverted practically unifluenced by the whirl.

Within the deviation means provided outside of the separator housing, an additional separator can be provided.

With the aid of the various following descriptions, the invention will be further explained in connection with the accompanying drawing showing schematically and by way of example, embodiments of the apparatus of the invention:

The separator shows a housing 1 in which a separation rotor axle 2 is supported, which in turn carries the symmetrically arranged vanes 3 of the separating rotor structure. The powder-air stream reaches from the disintegrating device into the separator housing 1 and passes the rotating separator rotor with its blades or vanes 3. Under the influence of the whirl produced through the separator rotor in the separation zone, which reaches approximately from the space below the rotor to the upper exit edges of the rotor, the too coarse components are transported to the outer wall of the housing and then fall back. The finished material leaves the separator with the air stream through an opening A. The approximate path of the powder-air stream and its components is shown by arrow ML; F for the finished material and G for the returning grit.

Figure 1:
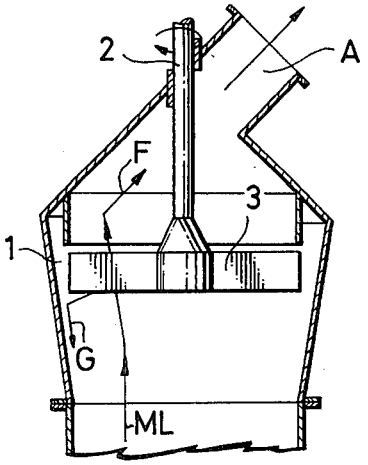
FIG.1 PRIOR ART
FIG. 1 is a diagrammatic showing of a known form of separator with a rotating fan.
Figure 2:
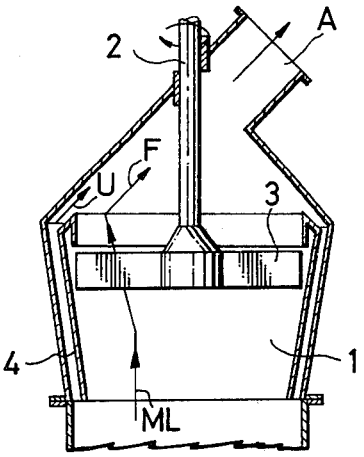
FIG. 2 shows a separator equipped with the by-pass of the invention.

If now a by-pass is constructed around the sorting zone, for example by means of a double-walled type of housing for the separator as illustrated by the inner casing 4 of FIG. 2, a part of the powder-air mixture (depending on the space of the ring between the inner casing 4 and outer casing 1), as shown by arrow U, can reach, the outlet of the separator without the influence of the separator fan, and be ejected through the resultant air whirl. The large particles carried along in the stream U are invisibly brought together with the usual finished stream F.

Figure 3:
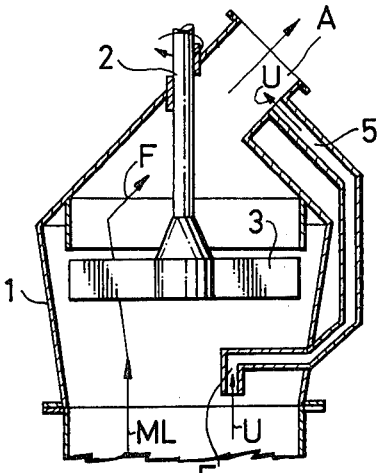
FIG. 3 shows a separator with a modified form of by-pass means.
Figure 7:
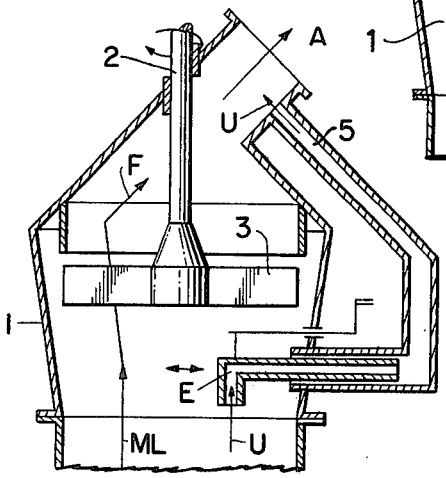
FIG. 7 is a view similar to FIG. 3 but showing a modified form of by-pass means.

Another possibility shown for the by-pass is illustrated in FIG. 3. Here the diverter 5 is provided outside of the separator housing 1. The place of withdrawal E for the by-pass stream U can be changed radially see FIG. 7. Thereby the portion of grit which reaches the by-pass stream U, can be changed. Instead of one such diverter 5, a plurality of such diverters which pass outside the separator housing can be provided.

Figure 4:
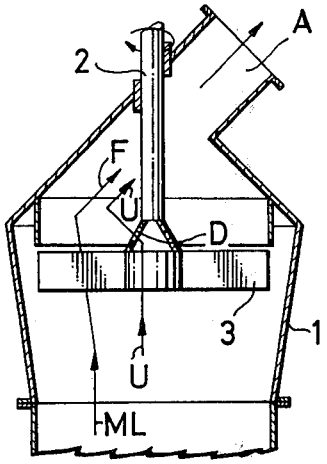
FIG. 4 shows another form of a by-pass installation.

A further possible construction is illustrated in FIG. 4. Here, the interior part of the fan 3, or the axle 2, of the supporting structure of the fan is equipped with a passageway D. Through the passageway the air component U of the particle-air stream ML can reach the airstream F without taking part in the whirl-producing action of the fan blades. In this case also, a control, in the sense of the invention, is possible.

Figure 5:
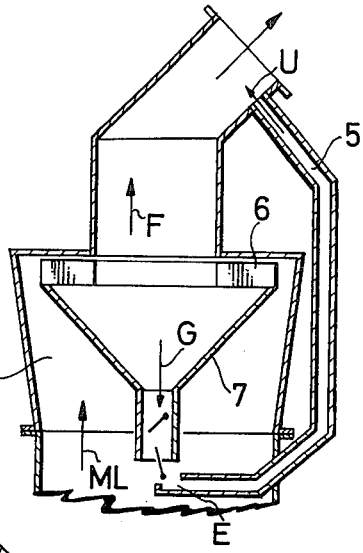
FIG. 5 is an embodiment of the invention as applied to a flap or vane type separator.

The illustrated by-pass possibility is also applicable to the so-called air-current-flap separator. A modification of this type is illustrated in FIG. 5. Instead of an air-wheel there appears here a ring of vanes 6 with adjustable vanes. The diverter 5 can be operated with lateral suction, as for example, the diverter 5 of FIG. 3. In the form shown, however, the withdrawal place E of diverter 5 is so arranged that the suction is possible from the back-flowing grit of the grit funnel 7.

Figure 6:
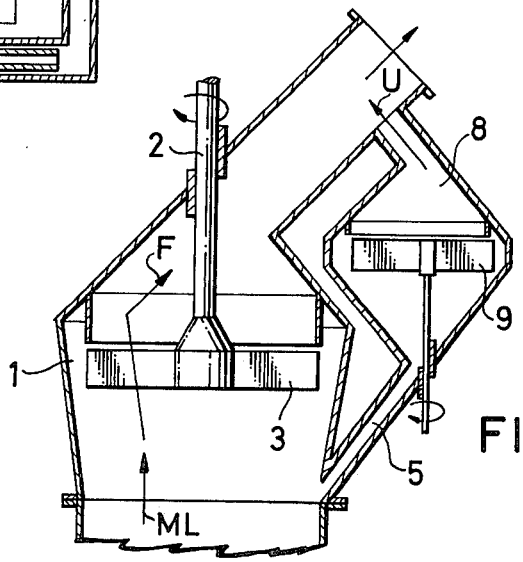
FIG. 6 shows, finally, a separator with a deviation means which is likewise provided with a separator.

In FIG. 6, finally, a modification is shown which is based on the structure of FIG. 3, in which however, the diverter 5 is provided with a housing 8 into which an auxiliary separator with a self-supporting and driven fan 9 is built.

I claim:

1. A separator for separating the larger particles from a powder-air stream such as obtain from a grinding mill and for recovering a power-air stream with a reduced but adjustable powder size distribution, said separator being of the type comprising a housing, means to create a swirl of air moving in one direction to provide a separation zone having an upstream side and a downstream side within said housing, means to admit a particle-air stream to the housing on the downstream side of said separation zone, and means to discharge a powder-air stream from which larger particles have been removed from the housing on the upstream side of the separation zone, the improvement comprising by-pass conduit means having an opening for receiving a portion of the powder-air stream extending into the downstream side of the separation zone and an opening for discharging said portion of the powder-air stream with the powder-air stream from which larger particles have been removed at the upstream side of said separation zone whereby a portion of the original powder-air stream by-passes the separation zone.

2. A separator as claimed in claim 1 wherein said by-pass conduit means has the form of an annular duct surrounding the separation zone, said annular duct being formed by an interior annular wall within said housing and spaced from the walls of the housing.

3. A separator as claimed in claim 1 wherein said by-pass conduit means comprising at least one tubular conduit with an inlet extending into the downstream side of the separation zone, said tubular conduit extending outside of the separator and having an outlet connecting to the discharge means of the separator.

4. A separator as claimed in claim 3 wherein said tubular conduit has an inlet which is adjustable laterally with respect to the powder-air stream.

5. A separator as claimed in claim 3 wherein at least one of the by-pass conduit means includes a second separator device constructed in the tubular means which extends outside of the main separator.

6. A separator as claimed in claim 1, wherein said means to create a swirl of air comprises a fan rotated about an axle extending into the separation zone with said axle extending in the direction of flow, said by-pass means comprising an opening adjacent the axle of said fan.

* * * * *